US009905914B2

(12) United States Patent
Scheim et al.

(10) Patent No.: US 9,905,914 B2
(45) Date of Patent: Feb. 27, 2018

(54) SLOT ANTENNA BUILT INTO A VEHICLE BODY PANEL

(71) Applicant: GM Global Technology Operations LLC, Detroit, MI (US)

(72) Inventors: Kobi Jacob Scheim, Pardess Hanna (IL); Mark Andrew Steffka, Canton, MI (US); Moshe Laifenfeld, Haifa (IL); Scott W. Piper, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/986,839

(22) Filed: Jan. 4, 2016

(65) Prior Publication Data

US 2016/0197398 A1 Jul. 7, 2016

Related U.S. Application Data

(60) Provisional application No. 62/100,535, filed on Jan. 7, 2015.

(51) Int. Cl.

| | |
|---|---|
| ***H01Q 1/32*** | (2006.01) |
| ***H01Q 13/18*** | (2006.01) |
| ***H01Q 1/28*** | (2006.01) |
| ***H01Q 21/28*** | (2006.01) |

(52) U.S. Cl.

CPC ..... *H01Q 1/3275* (2013.01); *H01Q 1/286* (2013.01); *H01Q 1/3283* (2013.01); *H01Q 13/18* (2013.01); *H01Q 21/28* (2013.01)

(58) Field of Classification Search

CPC ..... H01Q 1/3275; H01Q 1/286

USPC ..... 343/713, 714

See application file for complete search history.

(56) References Cited

U.S. PATENT DOCUMENTS 4,707,700 A * 11/1987 Nagy ..... H01Q 1/3275 343/712
4,792,809 A * 12/1988 Gilbert ..... H01Q 13/106 343/770
4,866,453 A * 9/1989 Nagy ..... H01Q 13/10 343/712
7,764,236 B2 * 7/2010 Hill ..... H01Q 1/243 343/702

(Continued)

*Primary Examiner* — Dameon E Levi
*Assistant Examiner* — Hasan Islam
(74) *Attorney, Agent, or Firm* — Cantor Colburn LLP

(57) ABSTRACT

Slot antennas built into metallic body panels utilize the vehicle body itself as an antenna radiator. Building the slot antennas directly into the metallic body panels converts the vehicle body from functioning as an RF shield into an RF antenna, which significantly improves mobile communication reception for a wide range of RF communication devices. Different types of slot antennas may be included for different communication channels utilized by different types of devices. Multi-band slot antennas are configured to receive multiple bands within a larger frequency channel. Dual-polarity antennas are configured to receive signals propagating in a dual-polarity mode. Multiple slot components may be configured as multi-band, dual-polarity antennas. Each slot antenna may be passive (without an RF pickup) or active with an RF pickup and coaxial cable connecting the antenna to an electronic device, such as receiver or amplifier located inside or otherwise interconnected with the vehicle.

11 Claims, 5 Drawing Sheets

(56) References Cited

U.S. PATENT DOCUMENTS

| | | | | |
|---|---|---|---|---|
| 2003/0080908 | A1* | 5/2003 | Mizutani | H01Q 1/3275 343/713 |
| 2004/0164912 | A1* | 8/2004 | Lindenmeier | H01Q 1/3216 343/713 |
| 2013/0342411 | A1* | 12/2013 | Jung | H01Q 1/243 343/767 |
| 2014/0354496 | A1* | 12/2014 | Hwang | H01Q 1/243 343/770 |
| 2015/0236426 | A1* | 8/2015 | Zhu | H01Q 13/10 343/702 |

* cited by examiner

SLOT ANTENNA BUILT INTO A VEHICLE BODY PANEL

CROSS-REFERENCE TO RELATED APPLICATION

This application is a Non-Provisional which claims the benefit of priority to U.S. Provisional Application Ser. No. 62/100,535 filed Jan. 7, 2015, the disclosure of which is incorporated herein by reference in its entirety.

FIELD OF THE INVENTION

The subject invention relates to vehicle communication systems and, more particularly, to a slot antenna built into a vehicle body panel.

BACKGROUND

Mobile computing devices capable of connecting with computer networks have become ubiquitous. Infrastructure allows a variety of mobile network devices to operate inside moving vehicles, such as radios, mobile telephones, tablet computers, navigation devices, automatic crash notification devices, theft notification systems, and so forth. Metallic vehicle bodies tend to shield electromagnetic signals propagating at the relevant wavelengths, which significantly attenuates or blocks service inside the vehicle unless an external antenna is utilized. While antennas mounted on the exterior of the vehicle improve reception, they add expense, require installation, detract from appearance, and increase wind resistance. After-market antennas can be inconvenient, often require professional installation, and may not be readily available for certain types of devices, such as mobile telephones and notebook computers. In addition, certain types of vehicles, such as convertibles, soft-top off-road vehicles and pickup trucks have limited installation options for external antennas. Installing multiple external antennas for different types of network devices presents a cluttered appearance that detracts from the stylish lines that many vehicle owners value.

Accordingly, improved antenna options are needed for mobile network devices operated within vehicles. More specifically, there is a need for antenna options that overcome the shielding effect of the metallic vehicle bodies without requiring external antennas to be mounted on the vehicle.

SUMMARY OF THE INVENTION

In one exemplary embodiment of the invention, a vehicle with an exterior body includes a metallic sheet portion and a slot antenna. The antenna includes a slot through the metallic sheet portion and a dielectric material filling the slot. The slot is filled with the dielectric material and sized to form a resonant antenna radiator for communication signals propagating within a target frequency band.

According to another, a metallic vehicle body part carries a slot antenna that includes a slot through the body part and a dielectric material filling the slot. The slot is filled with the dielectric material is sized to form a resonant antenna radiator for communication signals propagating within a target frequency band.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
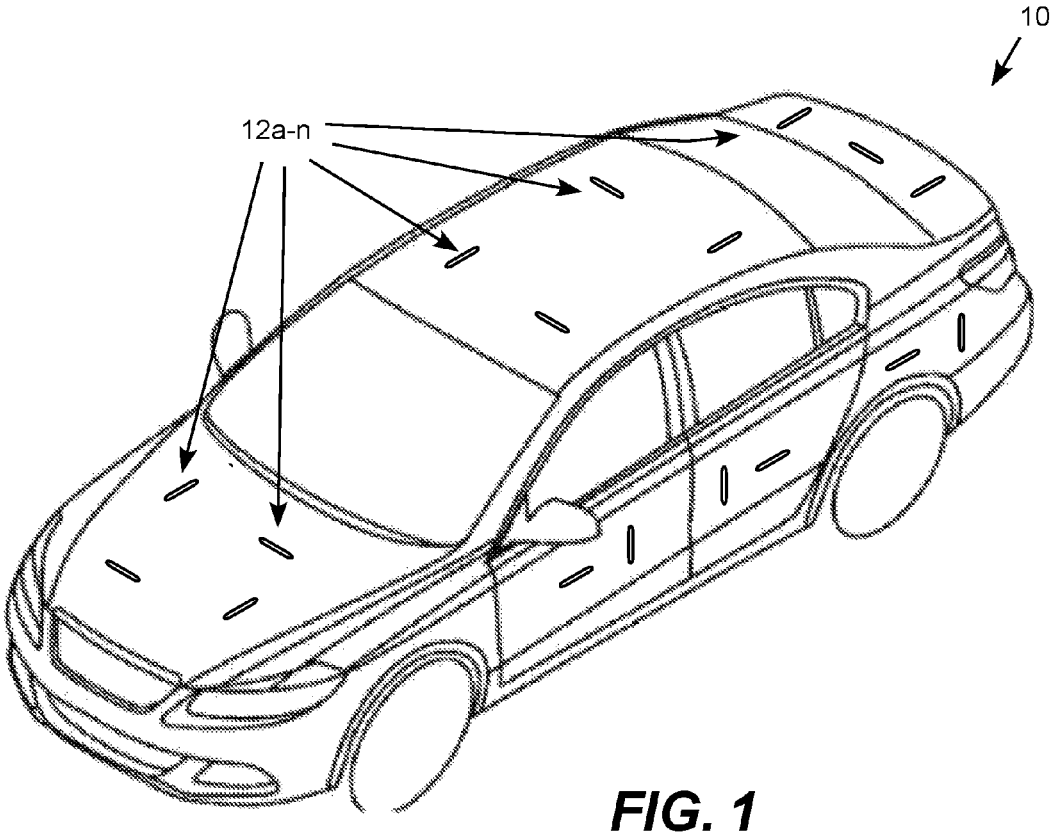
FIG. 1 is a conceptual illustration of an automobile carrying a number of slot antennas built into metallic body panels in accordance with an embodiment.

The following description is merely exemplary in nature and is not intended to limit the present disclosure, its application or uses. It should be understood that throughout the drawings, corresponding reference numerals indicate like or corresponding parts and features. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

According to an embodiment, a vehicle includes an exterior body having a metallic sheet portion and a slot antenna that includes a slot through the metallic sheet portion and a dielectric material filling the slot. The slot is sized to form a resonant antenna radiator for communication signals propagating within a target frequency band. The slot typically has a length dimension corresponding to an integer multiple of a half-wavelength of the target frequency propagating in the dielectric material. Exterior body paint typically covers an exterior side the metallic sheet portion, the slot, and the dielectric material visually concealing the antenna. In most cases, an additional fine tuning phase considering the vehicle materials (e.g., painting, metal sheet and di-electric material forming the slot antenna) and the vehicle geometry is carried out to optimize the antenna performance. This process often results in a final antenna configuration that varies somewhat from of the above-mentioned general rule, which is considered useful as a general initial guideline or "rule of thumb."

According to an aspect of an embodiment, a first radio frequency (RF) pickup element is electrically connected to the metallic sheet portion adjacent to a first elongated side of the slot and a second RF pickup element is electrically connected to the metallic sheet portion adjacent to a second elongated side of the slot. The RF pickup is typically located on an underside of the metallic sheet portion opposite the painted exterior side. A coaxial cable connected to the RF pickup may run along the underside of the body part. A headliner or other interior body component may conceal the coaxial cable from view from inside the vehicle. An amplifier or receiver may be connected to the coaxial cable and configured to engage in RF communications via the slot antenna.

In various alternative embodiments, a number of slot antennas may be located on the same exterior body part or on different body parts. The slot antenna may include a second slot oriented perpendicular to the first slot to form a dual-polarity slot antenna. One or more additional slots may be oriented parallel and adjacent to the first slot having a length different from the first slot forming a multi-band slot antenna. In another alternative, the antenna includes multiple slot components having different lengths extending in a first direction interconnected with multiple slot components having different lengths extending perpendicular to the first direction forming a multi-band, dual-polarity slot antenna. The vehicle may include a number of slot antennas configured for communications in a number of different frequency channels dedicated to different types of communication devices. In another exemplary embodiment of the invention, a vehicle body part includes one or more slot antennas. That is, embodiments of the invention include a vehicle carrying one or more slot antennas and an exterior body part carrying one or more slot antennas.

Building slot antennas into a metallic body panels turns the vehicle body itself into an antenna radiator. This represents a paradigm shift in vehicle communication systems away from the conventional approach, which has been to use external antennas or accept the RF shielding effect of the vehicle body for network devices that do not utilize external antennas. Building the slot antennas directly into the metallic body panels converts the vehicle body itself from an RF shield into an RF antenna, which significantly improves mobile communication reception for a wide range of RF communication devices located inside or otherwise interconnected with the vehicle. Different types of slot antennas may be included for different communication channels utilized by different types of devices, such as mobile telephones, wifi devices, automatic crash notification devices, vehicle theft notification devices, and so forth. Multi-band slot antennas are configured to receive multiple bands within a larger frequency channel.

For example, a multi-band slot antenna may support multiple mobile telephone bands within a larger communication channel reserved for mobile telephone communications. Dual-polarity antennas may be used to receive signals propagating in a dual-polarity mode. Multiple slot components may be configured as multi-band, dual-polarity antennas. Any of the slot antennas described in this disclosure may be deployed in a passive configuration (without an RF pickup) or an active configuration with an RF pickup and coaxial cable connecting the antenna to an electronic device, such as receiver or amplifier located inside or otherwise interconnected with the vehicle.

It should therefore be appreciated that RF pickups are not required in passive configurations and that specially shaped pickup elements (probes) are not required in active configurations. Rather, the slot is shaped to act as a resonator for the target frequency effectively tuning the metallic vehicle body panel in the area near the slot to the target frequency. This allows the RF pickup elements positioned alongside the slot to receive the communication signals propagating in the metallic body at the target frequency due to the presence of the slot. It should also be noted that the length of the slot is selected to be a resonator for the target frequency propagating in the dielectric material (i.e., an integer multiple of a half-wavelength ($n\lambda/2$) of the target frequency propagating in the dielectric material or, in most cases, a more specifically designed length which is an outcome of a fine tuning process considering all the antenna related geometry and structure parameters), whereas the RF pickup elements receive the signal at the target frequency propagating mainly along the surface of the metallic vehicle body. The ability of the slot antenna to locally tune the metallic vehicle body itself in a manner that can be picked up with a pair of RF pickup elements electrically connected to the body panel near the slot was an unexpected result. Even without RF pickups, the effectiveness of a properly sized slot antenna to pass RF signals at a target frequency through the body panel was also unexpected. While most antennas include conductive elements shaped to correspond to the target frequency, the present invention shapes the slot (i.e., an absence of conductive material) in the conductive vehicle body to correspond to the target frequency. This basic approach can be leveraged to create a range of more sophisticated antenna configurations in an inexpensive, easily manufactured, highly effective, and visually concealed manner.

In another setting of the slot antenna, a multiple-output-multiple-input (MIMO) setting is proposed. Modern transceivers use multiple antennas to feed both their receiver and transmitter. This approach along with corresponding newly introduced modulation and demodulation schemes have been shown to improve performance in mobile wireless broadband communications. The introduced slot antenna is also suitable for the MIMO setting where few different slots are actively connected to different transceiver feeds.

In accordance with an exemplary embodiment of the invention, FIG. 1 is a conceptual illustration of an automobile 10 carrying a number of slot antennas 12*a-n* built into the metallic body panels of the vehicle. This figure illustrates the basic concept of including one or more slot antennas built into one or more metallic body parts of the vehicle, which effectively converts the metallic body of the vehicle into an antenna radiator. Only a few representative slot antennas shown on the vehicle are enumerated to avoid cluttering the figure. Locating a number of different slot antennas on different vehicle body panels having different orientations helps to maintain high quality reception as the vehicle changes orientation with respect to the propagation angles of the communication signals. Although the figure shows the same type of single-slot antenna in each location, a range of different types of more sophisticated antennas may be employed, as described below.

Figure 2:
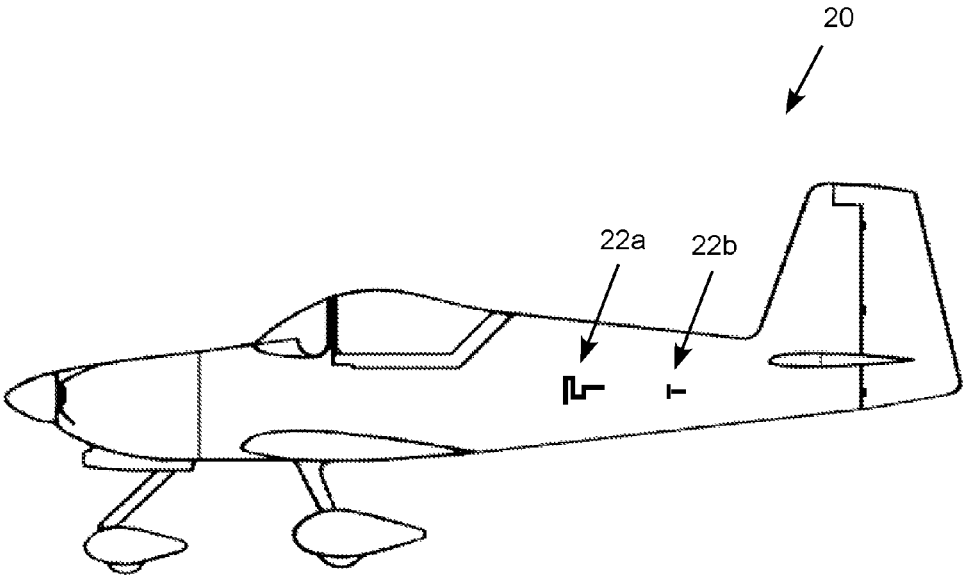
FIG. 2 is a conceptual illustration of an aircraft carrying a number of slot antennas built into metallic body panels in accordance with an embodiment.

Slot antennas built into vehicle body panels are well suited to automobiles but not limited to this particular type of vehicle. The same approach may be applied to any type of metallic container that houses mobile communication devices. The range of potential applications will therefore continue to increase as communication devices continue to proliferate. As another example, FIG. 2 illustrates an aircraft 20 carrying a number of slot antennas 22*a* and 22*b* built into the metallic body panels of the aircraft. Other illustrative examples include trucks, cargo containers, train cars, marine ships, rotary aircraft, unmanned aerial vehicles, space craft, missiles and so forth.

Figure 3A:
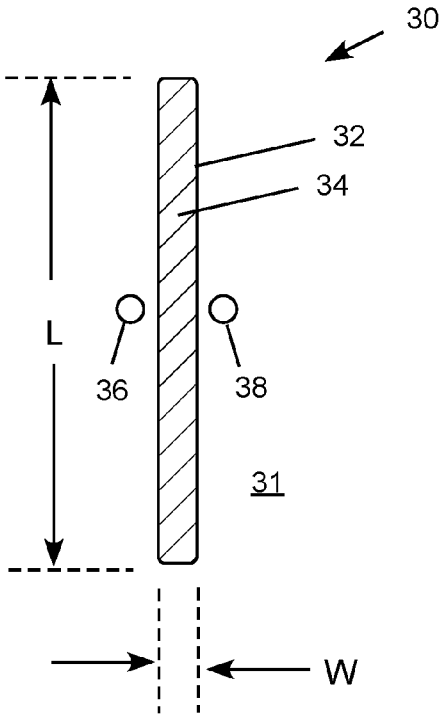
FIG. 3A is a front view of an illustrative active single-band, single-polarity slot antenna built into a metallic vehicle body panel in accordance with an embodiment.

FIG. 3A is a front view of an illustrative single-band, single-polarity slot antenna 30 built into a metallic vehicle body panel 31. The basic antenna includes a slot 32 through a metallic body panel 31 filled with a dielectric material 34. The dielectric material should be flexible yet durable in its intended application and exhibit a relatively high dielectric constant, such as about two to four ($2<\in_r<4$, where the vacuum dielectric constant equals: $\in_r=1.0$ by convention). While a higher dielectric constant generally allows the slot to be smaller for the same target frequency, it will be appreciated that the dielectric constant is not a limiting factor and materials having a range of dielectric constants may be utilized. Many polymeric resins, fiberglass, polymers, composites and other types of dielectric materials will work satisfactorily as the dielectric material. The slot 32 has a length "L" that corresponds to an integer multiple of a half-wavelength ($n\lambda/2$) of the target frequency propagating in the dielectric material 34 to form a resonant cavity for the target frequency. In most cases, an additional fine tuning phase considering the vehicle materials (e.g., painting, metal sheet and di-electric material comprising the slot antenna) and the vehicle geometry is carried out to optimize the antenna performance. This process ends up, most likely, in a more general form of the antenna that might be somewhat away of the above-mentioned rule of thumb. Since duplex communication channels have a frequency gap between transmit and receive bands, precise length correspondence to a precise frequency cannot be expected. In addition, exact correspondence is not required for functional performance. From a practical standpoint, a rule of thumb for the length of the slot should correspond sufficiently closely to an integer multiple of a half-wavelength of the nominal target frequency to allow the slot to function as a resonator for signals propagating at the target frequency. The actual design phase crosses a fine tuning process considering additional effects related with the materials and geometry targeted to optimize the slot antenna performance to the particular vehicle model and use case.

The integer multiple is typically selected to produce a slot antenna with a length well suited to incorporation in a vehicle body panel 31 from a manufacturing perspective, such as a length in the range of 5-10 cm. The slot 32 also has a width "W" that should be much less than the length. In general, the width of the slot controls the sharpness of the reception band (Q) of the slot antenna. It should therefore be sufficiently wide to accommodate both the transmit and receive sub-bands for a target duplex communication application, while also being sufficiently narrow to define a functional band-pass filter around the target frequency and avoid interference from other signals. As a general guide, a slot width in the 5-10 mm range is considered to be suitable for a slot antenna having a length in the 5-10 cm range. It will be appreciated, however, that these are only general guidelines and the specific length and width of a specific slot antenna for a specific target frequency will be a matter of design choice.

Figure 3B:
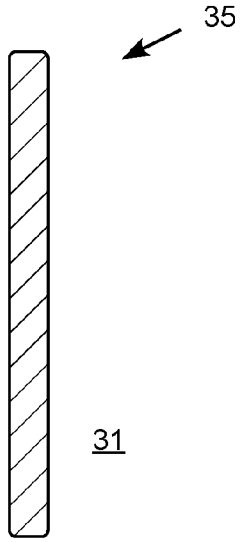
FIG. 3B is a front view of an illustrative passive single-band, single-polarity slot antenna built into a metallic vehicle body panel in accordance with an embodiment.

Each slot antenna may be passive (without an RF pickup) or active with an RF pickup and coaxial cable connecting the antenna to an electronic device, such as receiver or amplifier located inside or otherwise interconnected with the vehicle. For example, a passive antenna may be supplied for mobile telephones and wifi devices that do not ordinarily connect to auxiliary antennas, whereas an RF pickup may be provided for radios, navigation devices, and automatic crash notification devices that ordinarily connect to auxiliary antennas. To illustrate the active configuration, FIG. 3A includes an RF pickup with a first RF pickup element 36 spaced apart from and adjacent to a first elongated side of the slot 32, and a second RF pickup 38 spaced apart from, and adjacent to, the opposing elongated side of the slot. The center conductor of a coaxial cable is ordinarily connected to one of the RF pickup elements and the shield conductor of the coaxial cable is ordinarily connected to the other pickup element. FIG. 3B shows an example of passive single-band, single-polarity slot antenna 35.

Figure 4A:
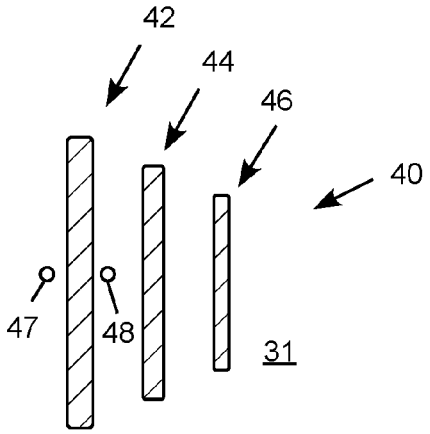
FIG. 4A is a front view of an illustrative active multi-band, single-polarity slot antenna built into a metallic vehicle body panel in accordance with an embodiment.
Figure 4B:
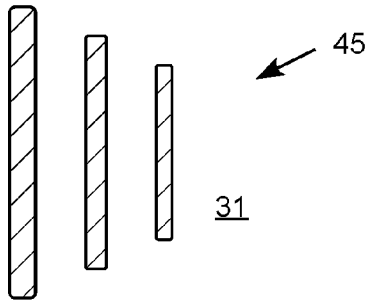
FIG. 4B is a front view of an illustrative multi-band, single-polarity slot antenna built into a metallic vehicle body panel in accordance with an embodiment.

FIG. 4A is a front view of an illustrative multi-band, single-polarity slot antenna 40 built into a metallic vehicle body panel 31. The multi-band antenna includes multiple slots, in this example slots 42, 44 and 46, typically arranged in parallel orientation and may be passive (without RF pickups) or active (with one or more pairs of RF pickup elements). This particular configuration includes a single pair of RF pickup elements 47, 48 for three slot antennas 42, 44 and 46. This allows the signals picked up by all three slot antennas to be transmitted on a single coaxial cable to a receiver that is configured to selectively tune among the signals received by the different slots. This type of multi-band antenna may be suitable for an application where signals are available in several different bands within a larger communication channel for a particular type of device. For example, each of the slot antennas 42, 44 and 46 may be sized to receive mobile telephone signals in a particular frequency band operated by a different carrier allowing the multi-band slot antenna 40 to pick up signals from all three carriers. It should be appreciated that in practice the composition of three slots may not necessarily correspond directly with three discrete frequencies associated with the respective slots. Rather, this type of structure can be expected to receive a range of frequencies related with the frequencies associated with the individual slots rather than a few discrete frequencies. FIG. 4B shows an example of passive multi-band, single-polarity slot antenna 45.

Figure 5A:
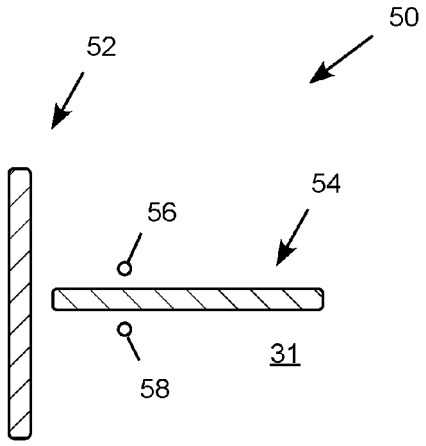
FIG. 5A is a front view of an illustrative active single-band, dual-polarity slot antenna built into a metallic vehicle body panel in accordance with an embodiment.
Figure 5B:
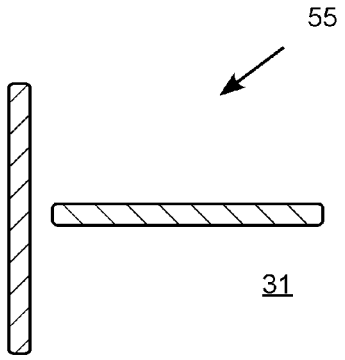
FIG. 5B is a front view of an illustrative passive single-band, dual-polarity slot antenna built into a metallic vehicle body panel in accordance with an embodiment.

FIG. 5A is a front view of an illustrative single-band, dual-polarity slot antenna 50 built into a metallic vehicle body panel 31. It will be appreciated that RF signals are communicated in a dual-polarity mode in some cases. To accommodate this situation, the slot antenna 50 includes two equally sized slots 52, 54 arranged perpendicular to each other. This type of slot antenna may also be deployed in a passive (without RF pickups) or active (with one or more pairs of RF pickup elements) configuration. In an active configuration, a single set of RF pickup elements 56, 58 is typically utilized for both slots 52, 54, which allows a single coaxial cable to transmit signals for both polarities to a receiver or amplifier inside the vehicle. FIG. 5B shows an example of passive single-band, dual-polarity slot antenna 55.

Figure 6A:
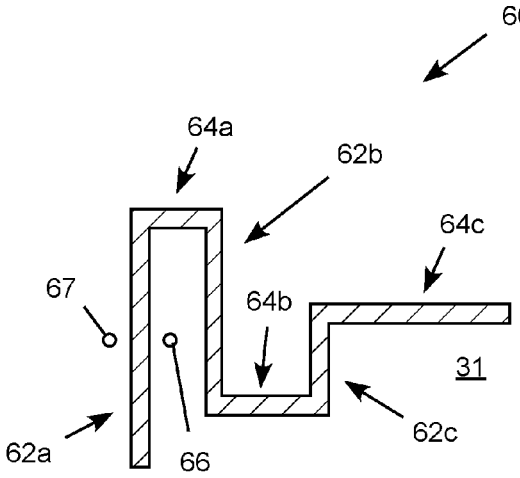
FIG. 6A is a front view of an illustrative active multi-band, dual-polarity slot antenna built into a metallic vehicle body panel in accordance with an embodiment.
Figure 6B:
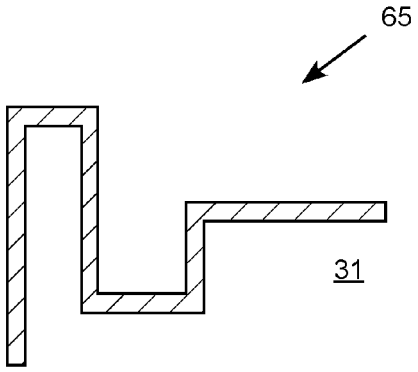
FIG. 6B is a front view of an illustrative passive multi-band, dual-polarity slot antenna built into a metallic vehicle body panel in accordance with an embodiment.

FIG. 6A is a front view of another alternative embodiment, a multi-band, dual-polarity slot antenna 60 built into a vehicle body panel 31. This antenna is configured as a single slot structure that has several slot components 62*a-c* extending in a first orientation (vertical) having different lengths interconnected with several other slot components 64*a-c* in a perpendicular orientation (horizontal) having different lengths. This configuration thus combines the multi-band approach of the antenna 40 shown in FIG. 4A with the dual-polarity approach of the antenna 50 shown in FIG. 5A into a single slot structure. As with all of the slot antennas in this disclosure, this type of antenna may be deployed in a passive (without RF pickups) or active (with one or more pairs of RF pickup elements) configuration. In an active configuration, a single set of RF pickup elements 66, 67 is typically utilized for the entire slot structure 60, which allows a single coaxial cable to transmit multi-band, dual-polarity signals to a receiver or amplifier inside the vehicle using a common coaxial cable. FIG. 6B shows an example of passive multi-band, dual-polarity slot antenna 65.

Figure 7:
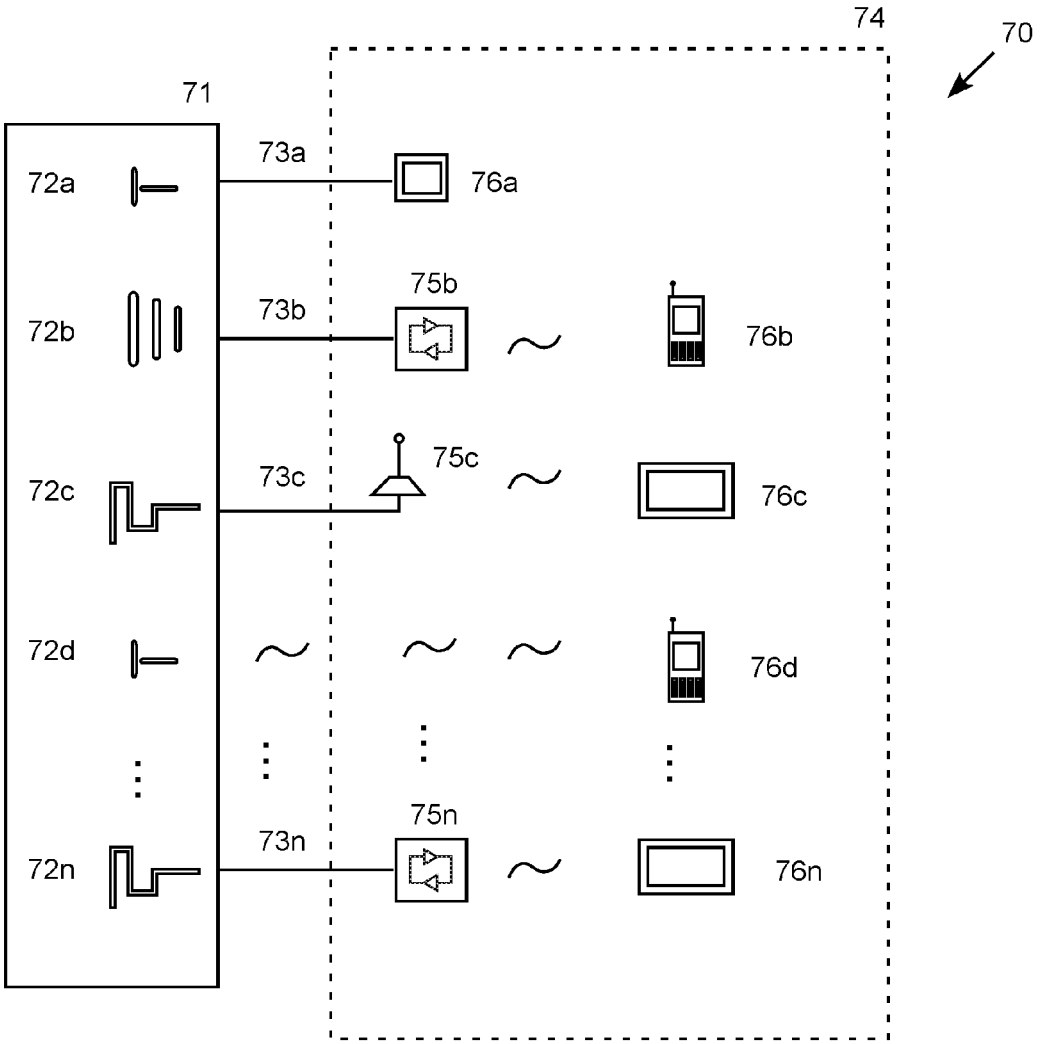
FIG. 7 is a schematic block diagram of a multi-channel communication system utilizing active slot antennas built into a vehicle body in accordance with an embodiment.

FIG. 7 is a schematic block diagram of a multi-channel communication system 70 utilizing active and passive slot antennas built into a vehicle body panel 31 to illustrate various alternative embodiments. A vehicle body 71 includes a number of slot antennas 72*a-n*, which may have different configurations as described above. For passive antenna configurations, only the slot antenna configuration itself is required. For active antenna configurations, an RF pickup is provided adjacent to slot antenna for connecting a coaxial cable that runs to a location inside the vehicle. The coaxial cable may be connected to a powered electronic device such as a receiver or amplifier, or an unpowered device such as another antenna radiator (rebroadcast antenna). It will be understood that these specific examples are merely illustrative and that other connection configurations may be utilized as a matter of design choice.

To illustrate these various alternatives, FIG. 7 shows a number of slot antenna 72*a-n* having different active and passive configurations, where certain slot antennas are connected to coaxial cables and other are not. As a first example, the cable 73*a* connects the antenna 72*a* to a receiver 76*a* that is ordinarily connected to an auxiliary antenna, such as a radio, navigation device, automatic crash notification device, automatic theft notification device, or the like. In this configuration, the antenna 72*a* replaces a conventional external antenna, such as whip or shark fin antenna often seen on vehicles today. As a second example, the cable 73*b* connects the antenna 72*b* to a powered bidirectional amplifier 75*b* that boosts mobile telephone signals for one or more mobile telephones 76*b* located inside or otherwise interconnected with the vehicle. Since the antenna 72*b* may be a multi-band antenna, it may support mobile telephone communicating signals in multiple bands operated by different carriers. As a third example, the cable 73*c* connects the antenna 72*c* to an unpowered antenna radiator 75*c* (rebroadcast antenna) located inside or otherwise interconnected with the vehicle the vehicle, which in this example provides improved data communication service to one or more tablet computers 76*c* located inside or otherwise interconnected the vehicle the vehicle. In a fourth example, the passive antenna 72*d* without an RF pickup provides improved communication service to one or more mobile telephones located inside or otherwise interconnected the vehicle. In a fifth example, the coaxial cable 73*n* connects the active antenna 72*n* to a wifi repeater 75*n*, which provides wireless, such as Internet or messaging service, to one or more of wireless computing devices located inside or otherwise interconnected with the vehicle represented by the notebook computer 76*n*. In each example, the antenna 72*a-n* may be a single-band or multi-band antenna, with single-polarity or dual-polarity radiators, supporting data communication signals in corresponding channels and modes operated by different carriers. In addition, each alternative may provide improved communication service to devices located inside the vehicle or, if desired, to devices that are operationally interconnected with the vehicle while the devices are located outside the vehicle. That is, it will be understood that the improved communication services provided by embodiments of the invention will work for mobile devices while they are physically located inside the vehicle as well as mobile devices located outside the vehicle so long as the devices remain operationally interconnected with the vehicle. The vehicle body itself may therefore serve as an antenna for providing improved communication services both inside the vehicle and in a zone around the vehicle. Addition of a bidirectional amplifier or auxiliary antenna can be expected to improve the ability of embodiments to provide improved communication services both inside the vehicle and in a zone around the vehicle.

Figure 8:
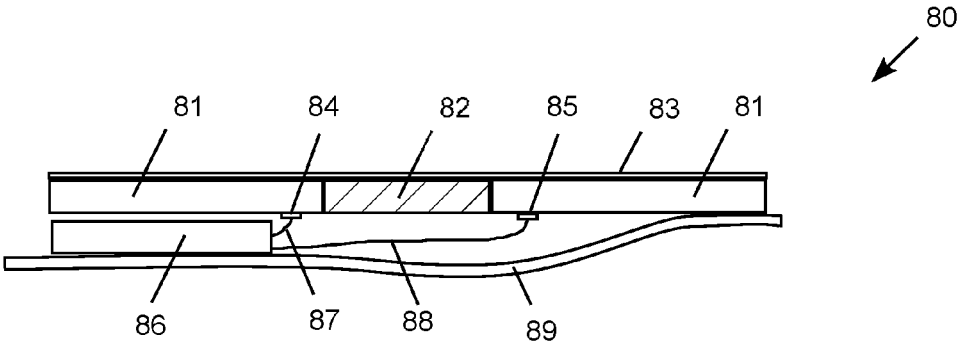
FIG. 8 is a schematic side view of a slot antenna built into a vehicle body panel and an associated coaxial cable pickup in accordance with an embodiment.

FIG. 8 is a schematic side view of a slot antenna 80 integrally built into a vehicle body panel 81. The dielectric material 82 fills the slot and lies under the exterior paint 83 making a smooth transition onto the body panel 81. The antenna is typically built into the vehicle body panel during the original manufacturing process allowing the original vehicle paint to be applied over the slot filled with the dielectric material visually concealing the antenna. That is, the slot antenna is not readily seen by an ordinary observer applying the usual amount of care when looking at the vehicle in a purchasing context. In an active configuration, the RF pickups 84, 85 are located on the underside of the body panel opposing the painted exterior body surface. A coaxial cable 86 running along the underside of the panel has a center conductor 87 electrically connected to the first RF pickup 84 and a shield conductor 88 connected to the other RF pickup 85. The coaxial cable and RF pickups are typically concealed by a headliner 89 or other interior body component. For aesthetic reasons, the cable may be positioned, or to the concealing part may be shaped or sufficiently firm, to avoid a lumpy appearance. In this manner, a number of slot antennas may be installed and wired as original vehicle equipment.

Figure 9:
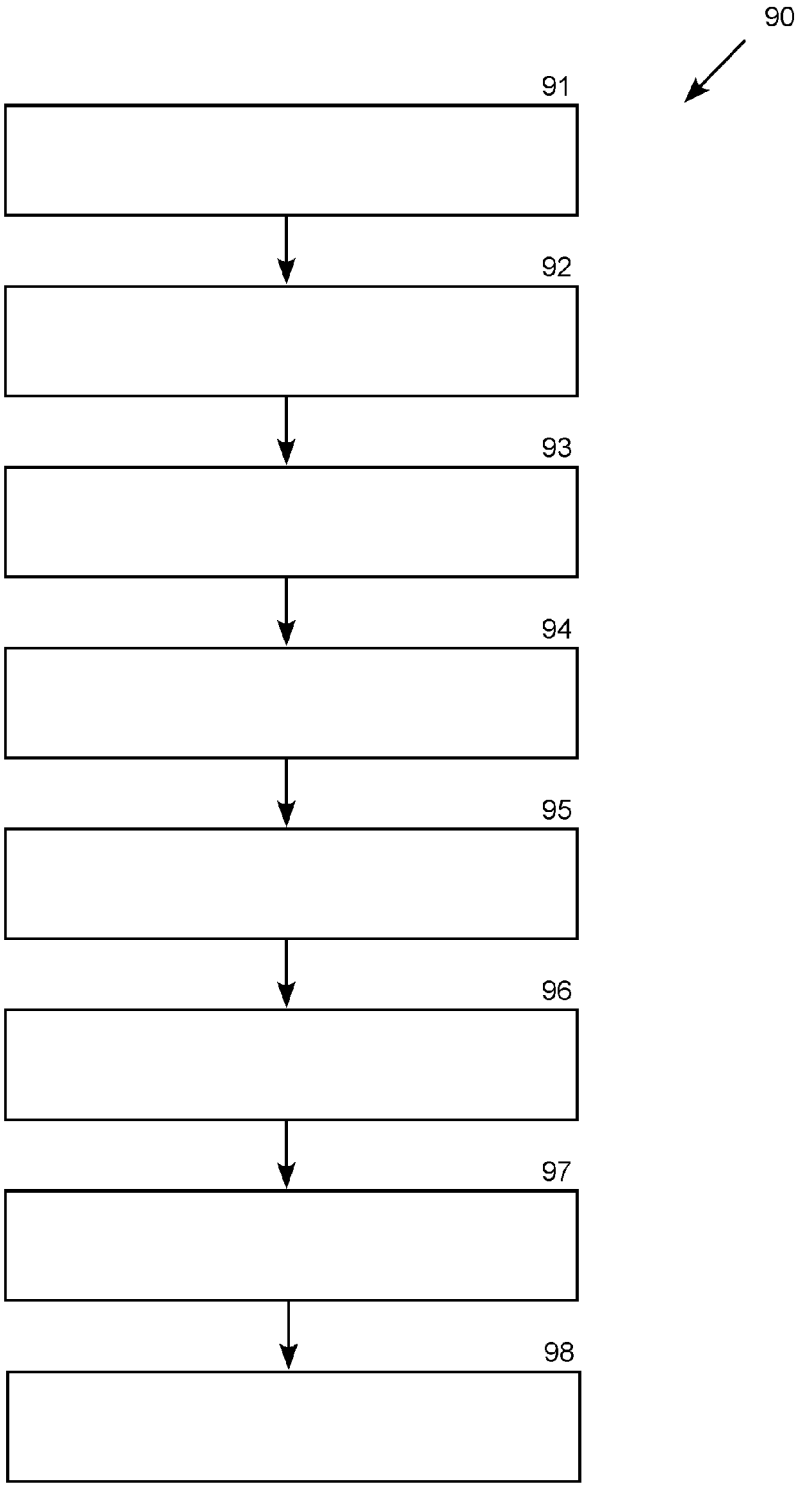
FIG. 9 is a logic flow diagram for configuring vehicles with integral slot antennas in accordance with an embodiment.

FIG. 9 is a logic flow diagram 90 for configuring vehicles with slot antennas built into exterior body parts. In block 91, the designer determines communication channels to be accommodated in the vehicle, such as channels for different types of devices. For example, channels may include those commonly used for AM/FM radio, satellite radio, navigation devices, mobile telephones, wifi and other data devices, automatic crash notification devices, theft notification devices, and so forth. In block 92, designer determines multiple bands to be supported within the communication channels. In block 93, designer determines multiple polarities to be supported within the communication bands. In block 94, designer determines which channel will be passive and which will be active. In block 95, designer determines a slot antenna layout, which may include multiple slot antennas in multiple body panels. In block 96, the slot antennas are built into the body panels during the original manufacturing process. In block 97, the active slot antennas are wired with coaxial cables during the original manufacturing process. In block 98, one or more active devices receivers and antennas may be attached to the antennas via the coaxial cables.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A vehicle including an exterior body comprising a metallic sheet portion and a slot antenna comprising:

a slot through the metallic sheet portion of the vehicle;

a dielectric material filling the slot; and exterior body paint covering an exterior side of the metallic sheet portion, the slot, and the dielectric material visually concealing the antenna from outside the vehicle, wherein dimensions of the slot are based on a dielectric constant of the dielectric material and a target frequency band and the slot forms a resonant antenna radiator for communication signals propagating within the target frequency band, and the slot has a length dimension resulting in a resonant condition of the target frequency propagating in the dielectric material corresponding to a mobile communication device configured to receive the target frequency enhanced by the slot when located inside the vehicle without a radio frequency (RF) pickup operatively connected to the vehicle adjacent to the slot.

2. The vehicle of claim 1, wherein the metallic portion is an exterior body part and the slot is a first slot, further comprising a number of other slot antennas located on a common exterior body part.

3. The vehicle of claim 1, wherein the metallic portion is an exterior body part and the slot is a first slot, further comprising a number of other slot antennas located on different exterior body parts.

4. The vehicle of claim 1, wherein the slot is a first slot, further comprising a second slot oriented perpendicular to the first slot forming a dual-polarity slot antenna.

5. The vehicle of claim 1, wherein the slot is a first slot, further comprising a second slot oriented parallel and adjacent to the first slot and having a length different from the first slot forming a multi-band slot antenna.

6. The vehicle of claim 1, wherein the slot further comprises a plurality of slot components having different lengths extending in a first direction interconnected with a plurality of slot components having different lengths extending in a second direction perpendicular to the first direction forming a multi-band, dual-polarity slot antenna.

7. The vehicle of claim 1, wherein the slot is a first slot, further comprising a number of other slots having different lengths configured for communication signals propagating within different frequency channels dedicated to different types of communication devices.

8. A metallic vehicle body part carrying a slot antenna comprising:

a slot through the body part of the vehicle;

a dielectric material filling the slot; and exterior body paint covering an exterior side the body part, the slot, and the dielectric visually concealing the antenna from the painted side of the body part, wherein dimensions of the slot are based on a dielectric constant of the dielectric material and a target frequency band and the slot forms a resonant antenna radiator for communication signals propagating within the target frequency band, and the slot has a length dimension resulting in a resonant condition of the target frequency propagating in the dielectric material corresponding to a mobile communication device configured to receive the target frequency enhanced by the slot without a radio frequency (RF) pickup operatively connected to the vehicle adjacent to the slot.

9. The vehicle body part of claim 8, wherein the slot is a first slot, further comprising a number of other slot antennas.

10. The vehicle body part of claim 8, wherein the slot is a first slot, further comprising a second slot oriented perpendicular to the first slot forming a dual-polarity slot antenna.

11. The vehicle body part of claim 8, wherein the slot is a first slot, further comprising a second slot oriented parallel and adjacent to the first slot and having a length different from the first slot forming a multi-band slot antenna.

* * * * *